US008353431B2

(12) United States Patent
Ward, II

(10) Patent No.: US 8,353,431 B2
(45) Date of Patent: Jan. 15, 2013

(54) SPRAY BOTTLE SUCTION STRAW DIVERSION DEVICE

(75) Inventor: John Wilmer Ward, II, Huntsville, AL (US)

(73) Assignee: John Wilmer Ward, II, Huntsville, AL (US)

( * ) Notice: Subject to any disclaimer, the term of this patent is extended or adjusted under 35 U.S.C. 154(b) by 6 days.

(21) Appl. No.: 12/748,027

(22) Filed: Mar. 26, 2010

(65) Prior Publication Data

US 2010/0176160 A1 Jul. 15, 2010

Related U.S. Application Data

(63) Continuation of application No. 29/329,640, filed on Dec. 18, 2008, now abandoned, which is a continuation of application No. 10/818,535, filed on Apr. 5, 2004, now abandoned.

(51) Int. Cl.
*B67D 7/78* (2010.01)

(52) U.S. Cl. ..... 222/464.7; 222/377; 222/382; 222/328; 220/676

(58) Field of Classification Search ..... 222/464.7, 222/377, 382, 324, 383.1, 328, 464.3, 464.1; 220/676, 640, 705
See application file for complete search history.

(56) References Cited

U.S. PATENT DOCUMENTS

| | | | |
|---|---|---|---|
| 721,112 | A | 2/1903 | Weaver et al. |
| 1,185,368 | A | 5/1916 | Colaiacoro |
| 2,688,424 | A | 9/1954 | Keiter |
| 2,722,086 | A | 11/1955 | Mullen |
| D199,699 | S | 12/1964 | Dailey |
| 3,379,358 | A | 4/1968 | Cvacho |
| 3,474,927 | A | 10/1969 | Bowles |
| D240,711 | S | 7/1976 | Angleman et al |
| 4,252,073 | A | 2/1981 | Hartung et al. |
| 4,314,095 | A | 2/1982 | Moore et al. |
| 4,570,808 | A | 2/1986 | Campbell et al. |
| D300,837 | S | 4/1989 | Prater |
| D301,307 | S | 5/1989 | Pakzad |
| 4,896,013 | A | 1/1990 | Fricke et al. |
| D316,035 | S | 4/1991 | Pepitone |
| 5,320,231 | A | 6/1994 | Iodice |
| 5,628,420 | A | 5/1997 | Hendrikse |
| 5,752,926 | A | 5/1998 | Larson et al. |
| 5,875,940 | A | 3/1999 | Mayfield |
| D413,806 | S | 9/1999 | Rosén |
| 6,059,152 | A | 5/2000 | Mayfield |
| D445,672 | S | 7/2001 | Sherman et al. |
| 6,419,111 | B1 | 7/2002 | Kepner |
| D470,593 | S | 2/2003 | Iodice |
| 6,871,760 | B1 | 3/2005 | Snider |
| D519,033 | S | 4/2006 | Romano |

FOREIGN PATENT DOCUMENTS

| | | |
|---|---|---|
| WO | DM/064003 | 1/2003 |

*Primary Examiner* — Kevin P Shaver
*Assistant Examiner* — Melvin Cartagena
(74) *Attorney, Agent, or Firm* — Maynard, Cooper & Gale, P.C.; Jon E. Holland

(57) ABSTRACT

A spray bottle that has a Suction Straw Diversion Device (SSDD) that diverts or directs the sprayer pump suction straw towards the perimeter of the bottle. This can be accomplished through the use of a protrusion, bar, tube, rail, plate, hook or any other device built into the bottle that will keep the suction straw diverted to the perimeter of the bottle and in the liquid thus allowing it to be dispensed.

8 Claims, 11 Drawing Sheets

Figure # 1
(PRIOR ART)
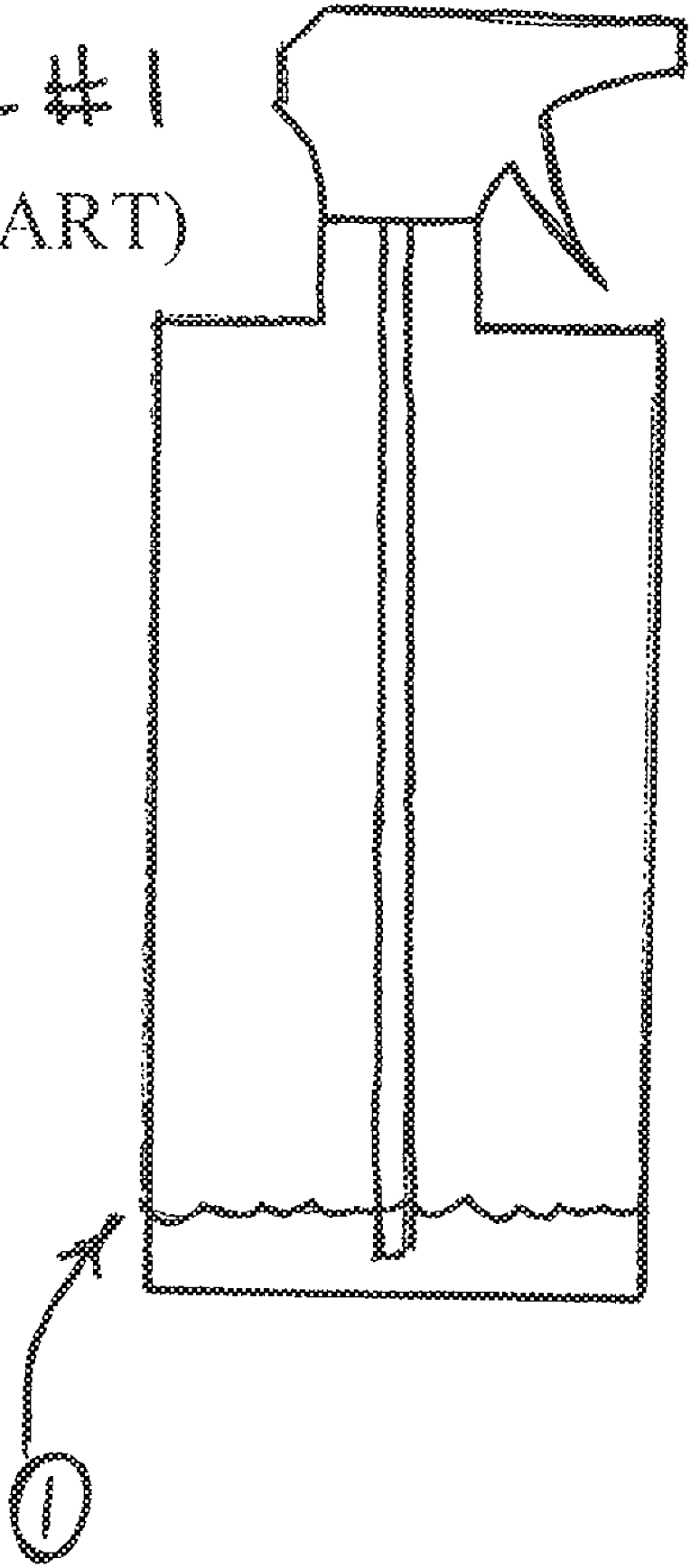

Figure #2
(PRIOR ART)
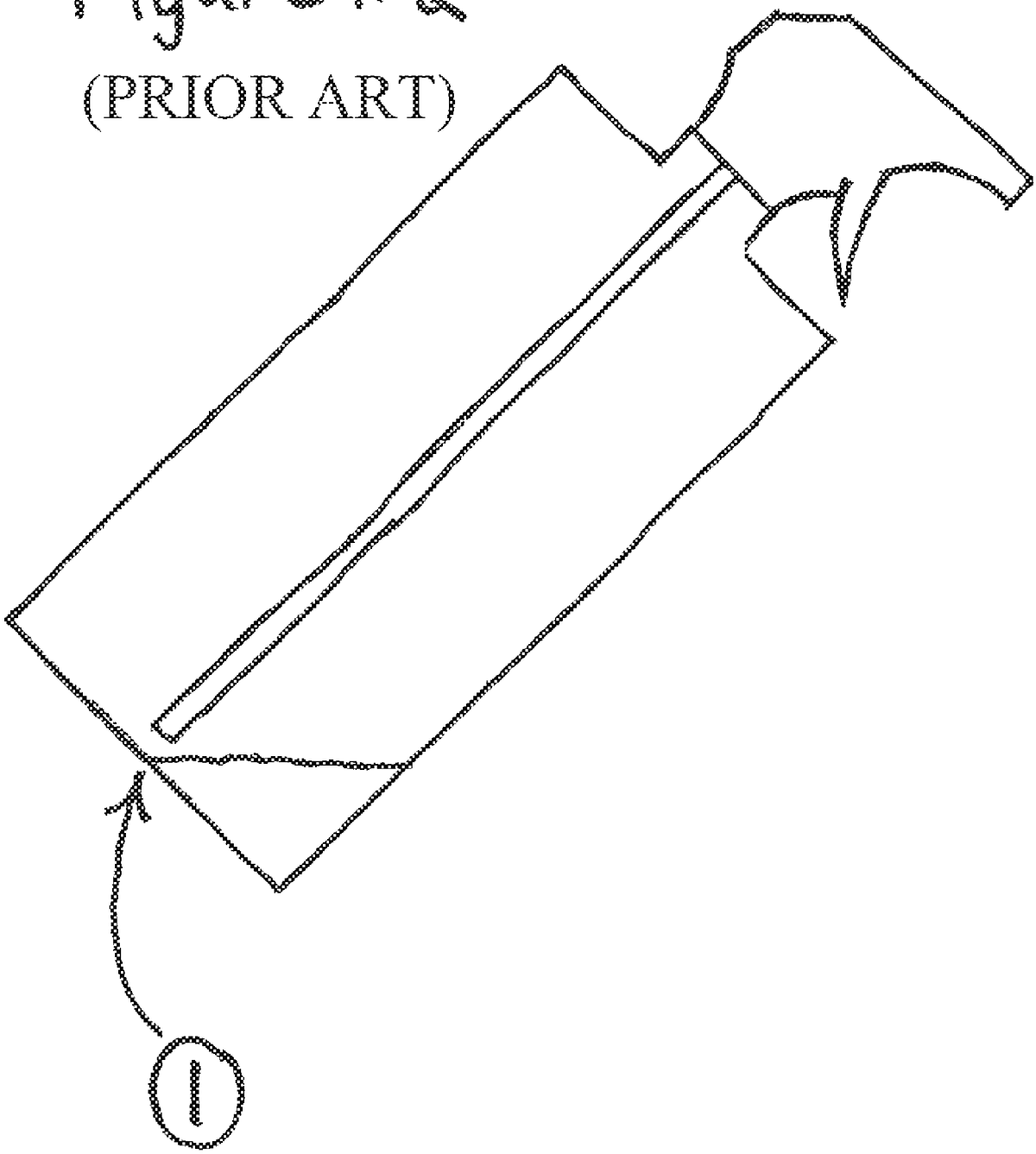

Figure#3
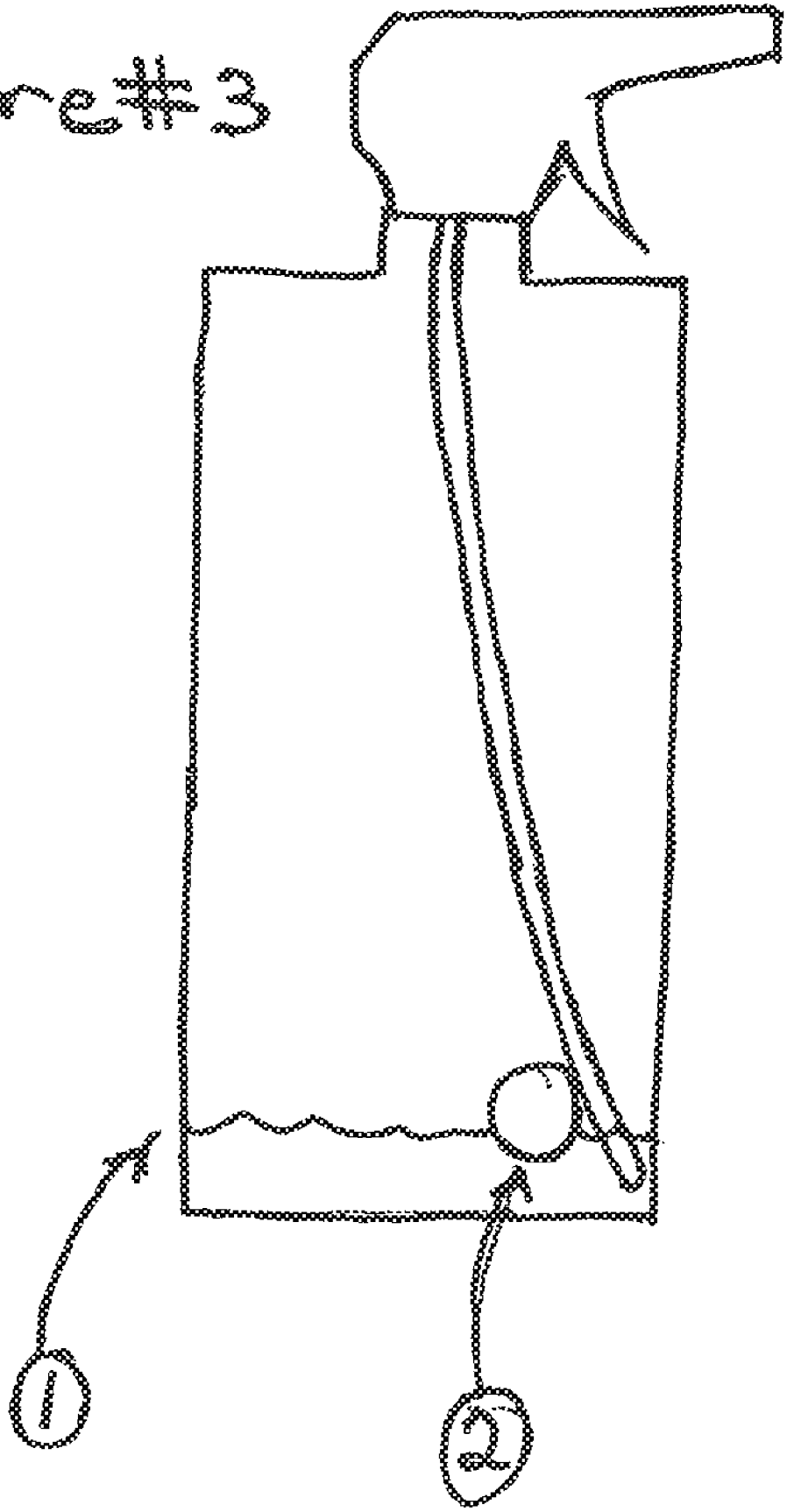

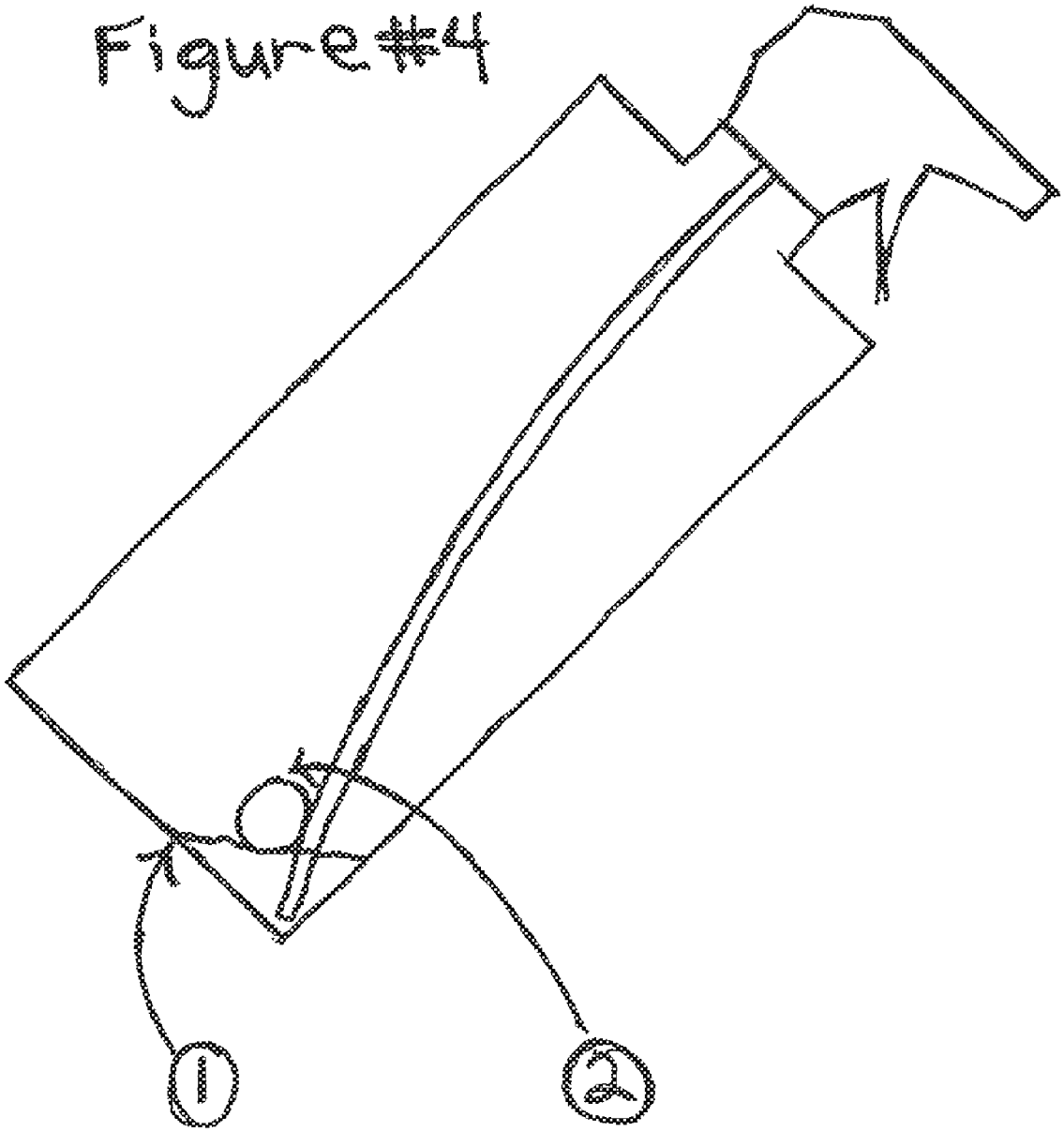
Figure#4
1
2

Figure #5
(PRIOR ART)
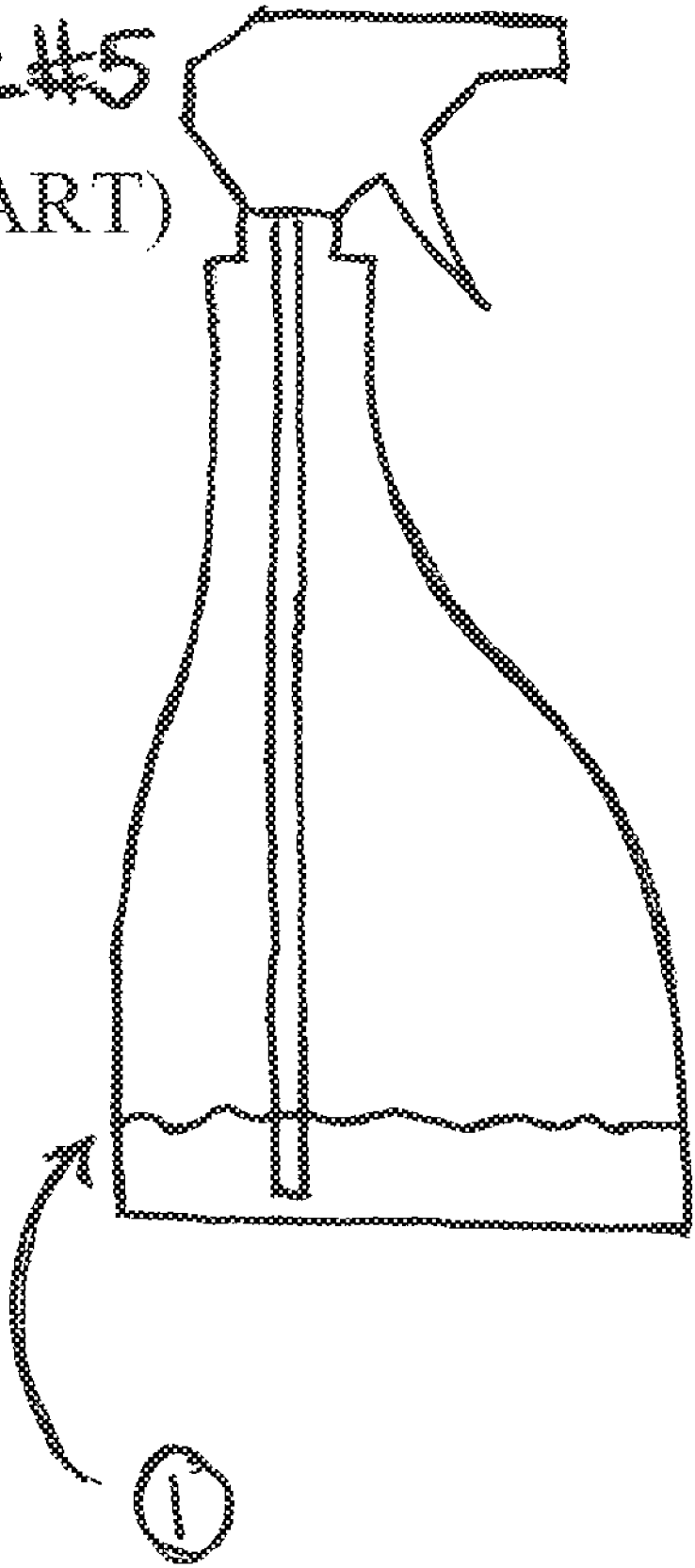

Figure#6
(PRIOR ART)
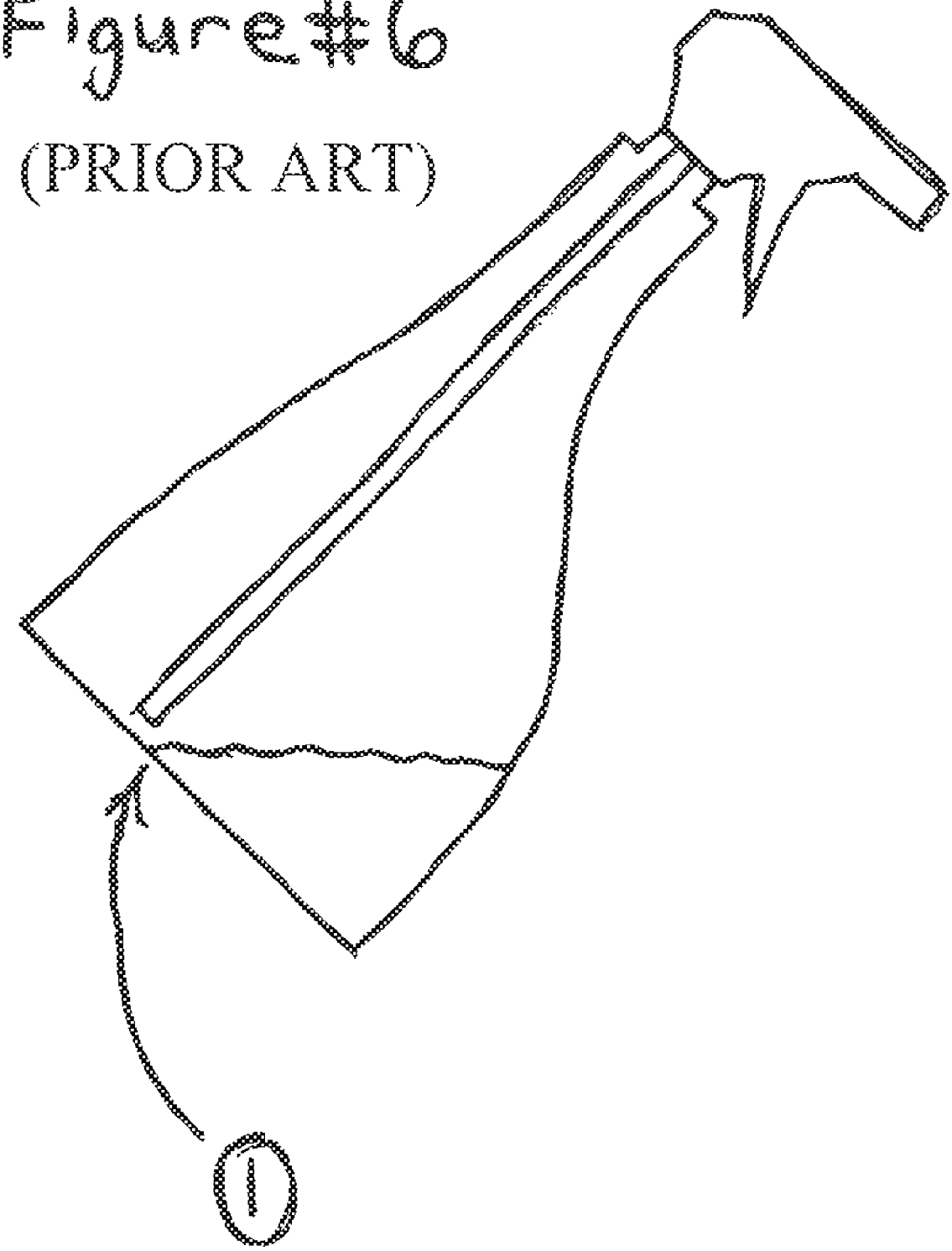

Figure #7
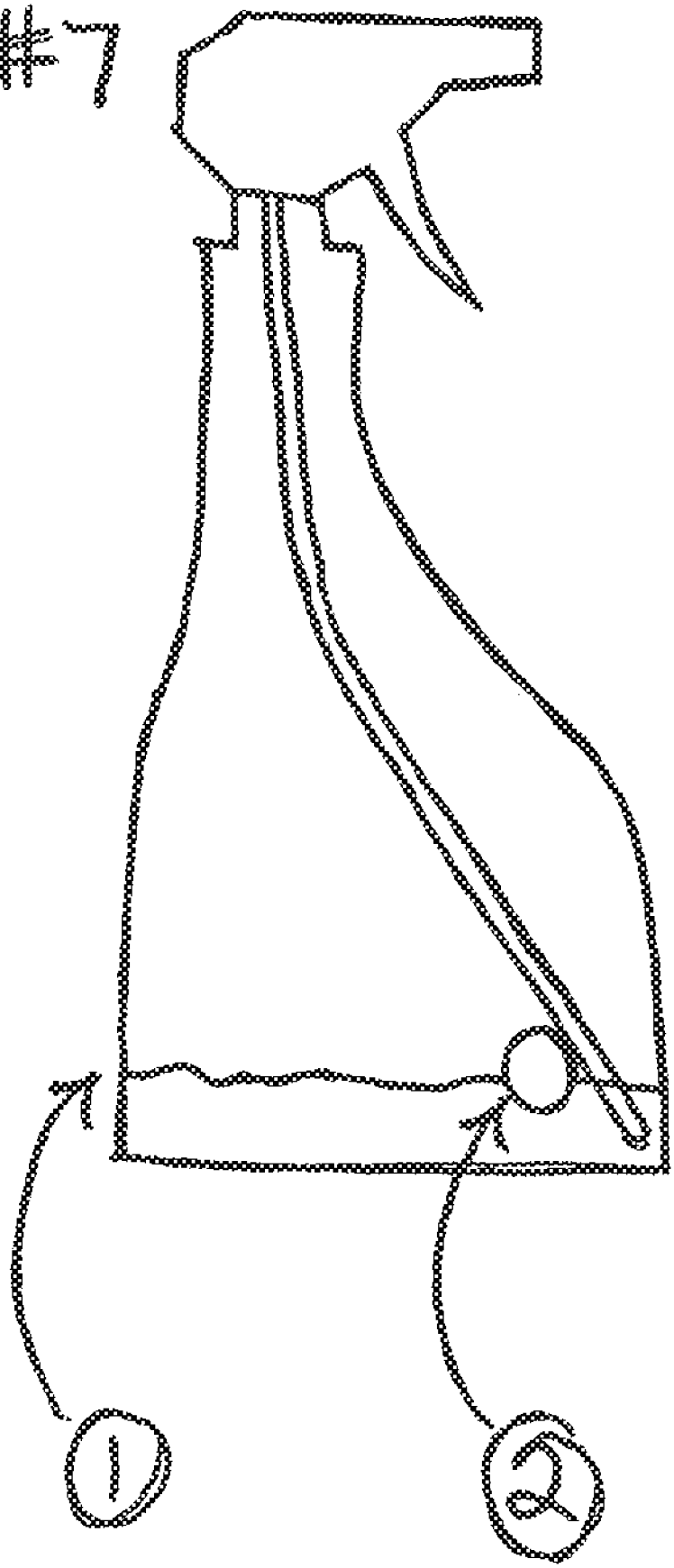

Figure #8
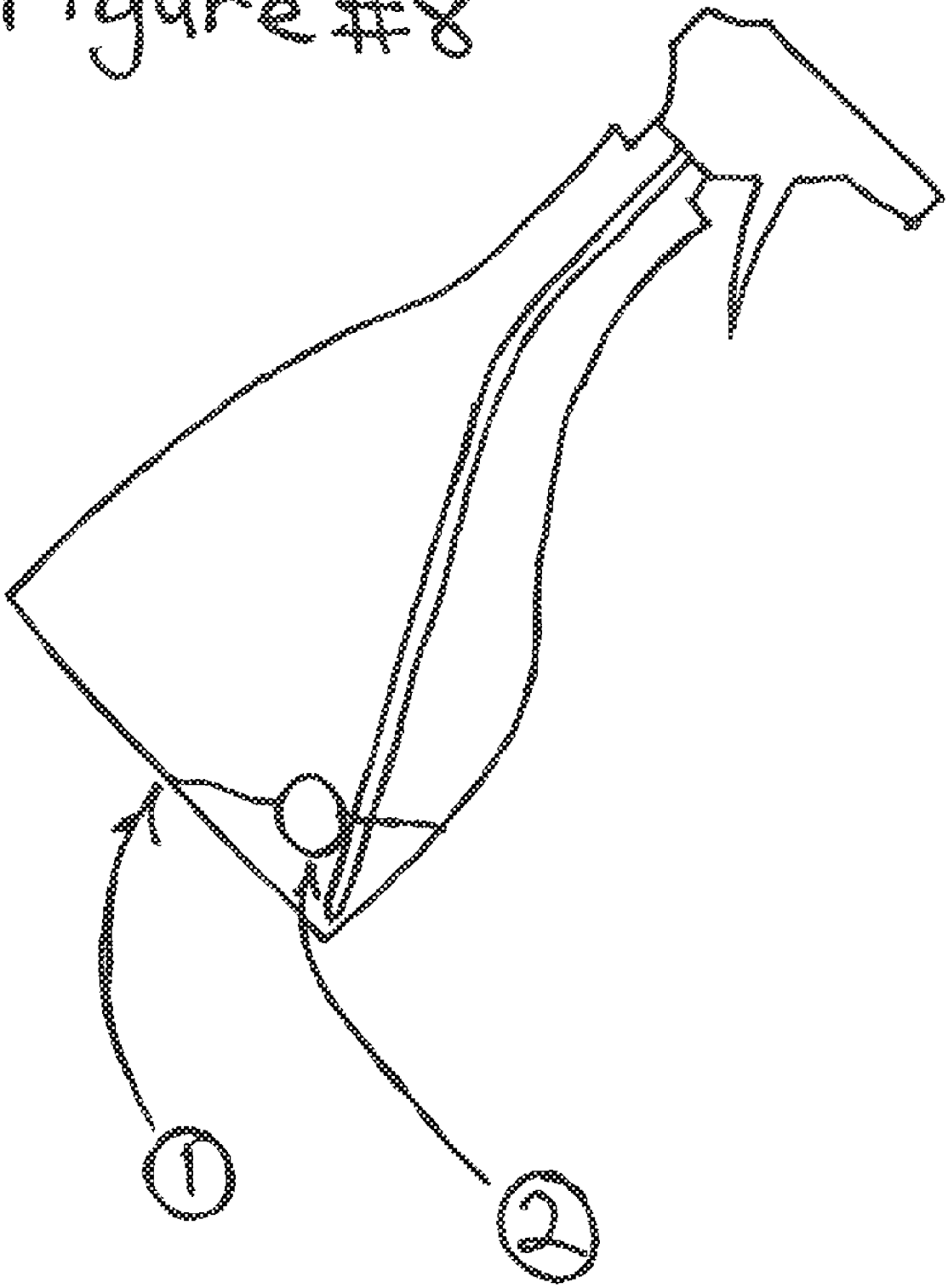

Figure#9
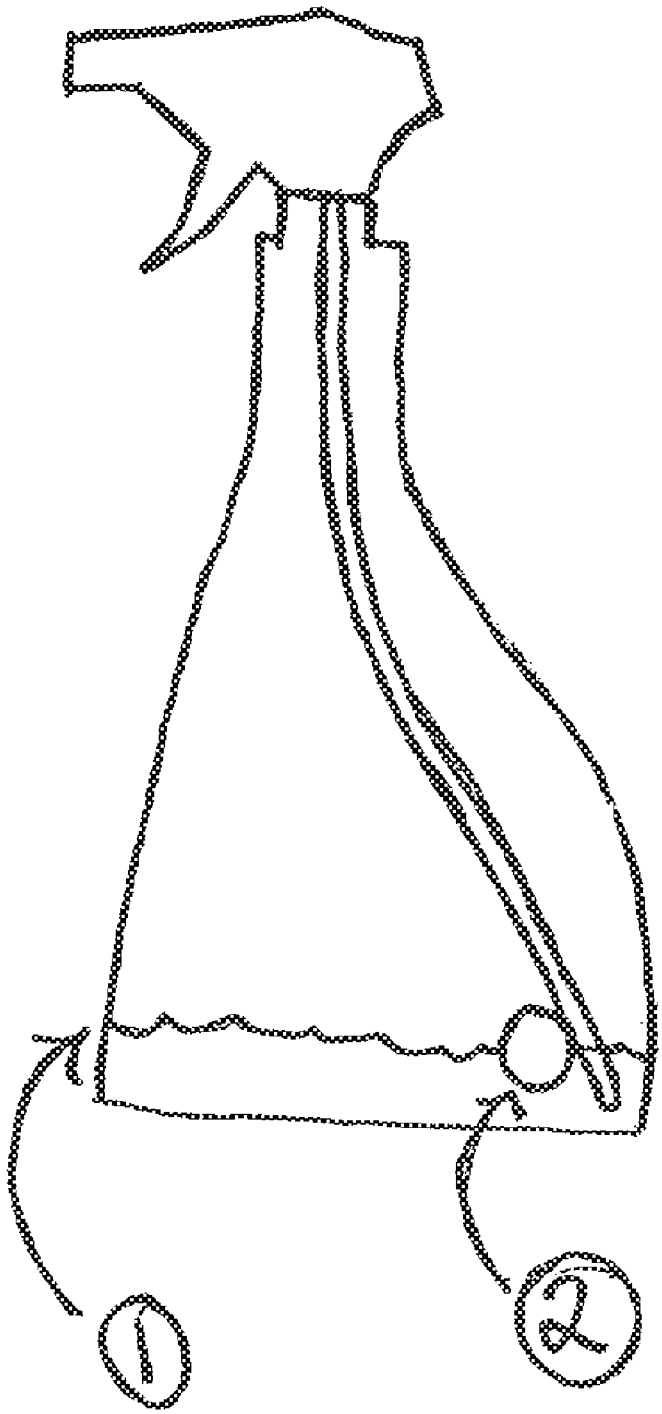

Figure #10
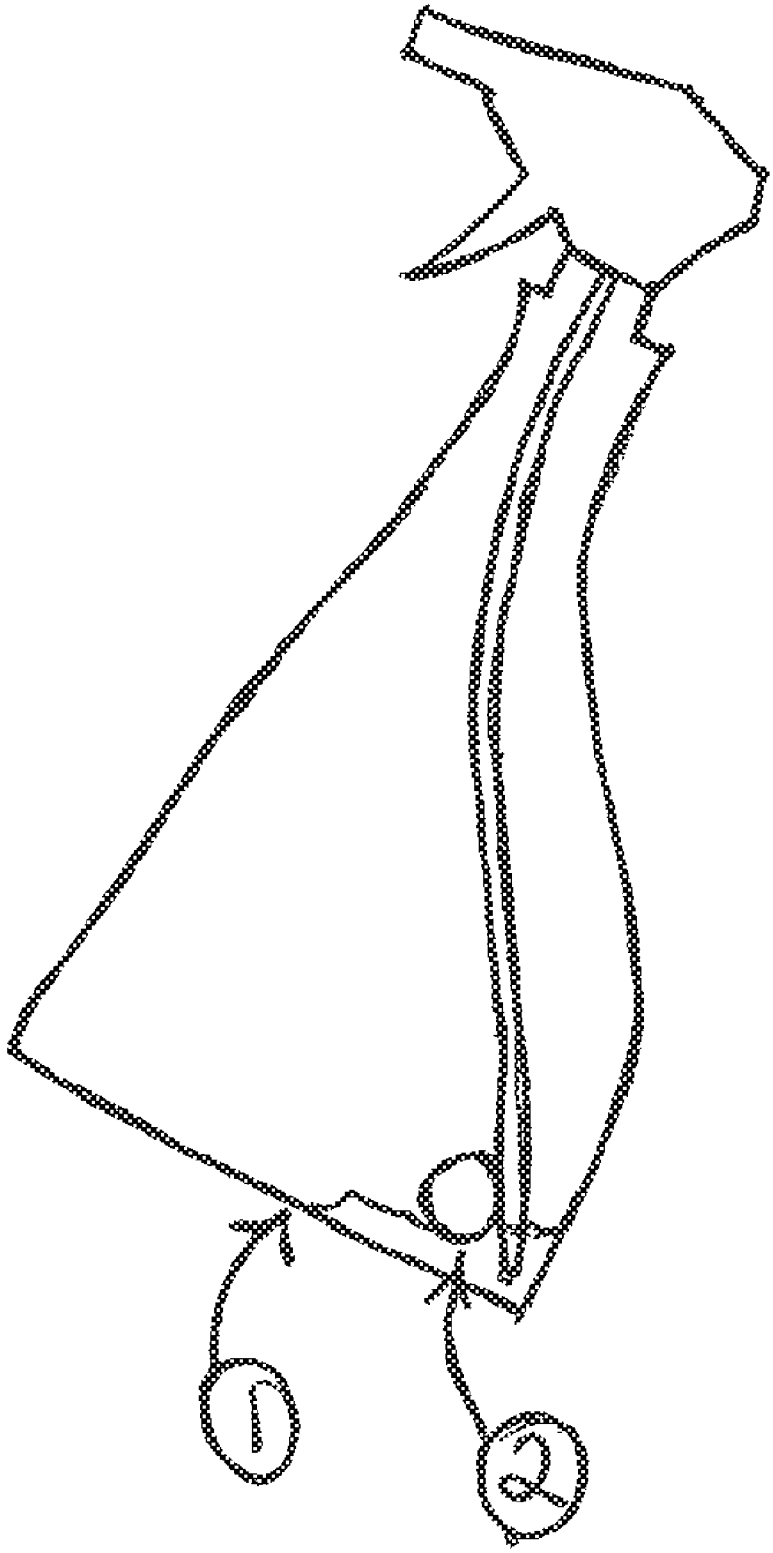

Figure#11
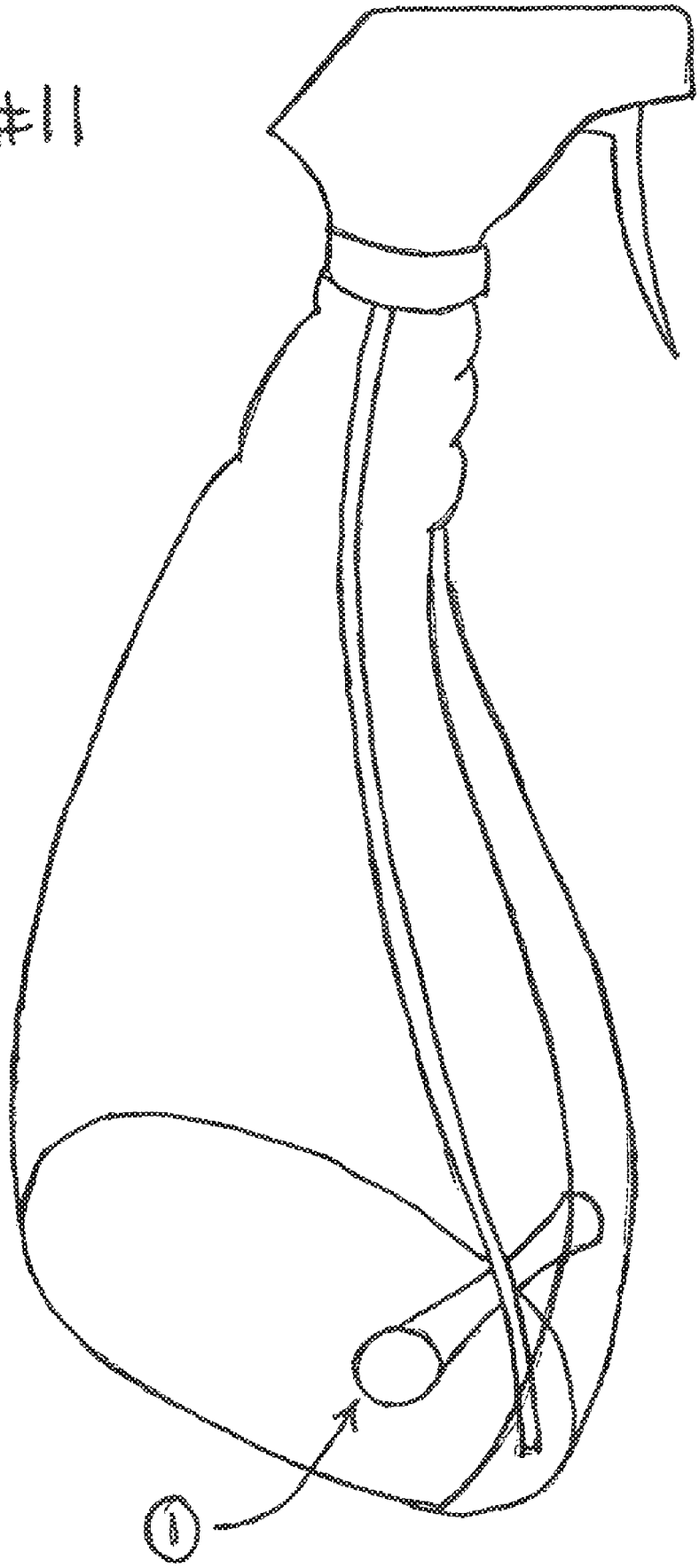

SPRAY BOTTLE SUCTION STRAW DIVERSION DEVICE

CROSS REFERENCE TO RELATED APPLICATIONS

This application is a continuation of and claims priority to U.S. patent application Ser. No. 29/329,640, entitled "Spray Bottle Suction Straw Diversion Device," and filed on Dec. 18, 2008, which is fully incorporated herein by reference. U.S. patent application Ser. No. 29/329,640 is a continuation of and claims priority to U.S. patent application Ser. No. 10/818,535, entitled "Spray Bottle Suction Straw Diversion Device," and filed on Apr. 5, 2004, which is fully incorporated herein by reference.

BACKGROUND OF THE INVENTION

1. Technical Field

This invention relates in general to bottles and in particular to spray bottles.

2. Description of Related Art

Bottles are used to contain liquids of various types.

Bottles are used to mix solutions or a solution and powder in order to achieve a mixture that is desired.

Bottles are used as part of an application device, as in a spray bottle, to spray liquids onto vertical and horizontal surfaces which may be higher or lower than the bottle is being held.

Currently, when purchasing a cleaning product at the store, the spray bottles do not allow the consumer to use as much of the product as possible, especially if spraying a horizontal surface where the spray bottle must be leaned forward to spray downward or backward to spray upward. In many cases this leaves between 40-80 ml of liquid in the bottle that can't be consumed using the sprayer as designed to be used as a sprayer applicator.

BRIEF SUMMARY OF THE INVENTION

This invention recognizes that spray bottles currently being used to dispense liquids through a pump sprayer do no adequately use as much of the liquid as possible.

Currently most spray bottles do not allow the user to use the last 40 to 80 milliliters of liquid in the bottom of the bottle when spraying the surface of a table or any other horizontal surface. A spray bottle with my invention of a suction straw diversion device allows the user to use all but approximately 0.5 to 1 milliliters by directing the sprayer suction straw towards the front of the bottle where the liquid pools when the bottle is tilted forward so that a horizontal surface can be sprayed and liquid is dispensed easily. It also allows the spray bottle to use as much of the liquid in the bottle as possible when spraying upward, simply by turning the sprayer device to face backwards, but leaving the suction straw directed toward the front of the bottle where the liquid will pool when the bottle is tilted.

BRIEF DESCRIPTION OF THE DRAWINGS

FIG. 1: shows a round spray bottle standing upright with very little liquid in the bottle. The sprayer suction straw is going straight down and is in the liquid thus allowing the liquid to be sprayed. (1) Indicates liquid level.

FIG. 2: shows a round spray bottle tilted forward with the sprayer suction straw going straight down and the liquid pooling a the front of the bottle not allowing the sprayer to spray the liquid. (1) Indicates liquid level.

FIG. 3: shows a round spray bottle upright with very little liquid with the sprayer suction straw diverted by the Suction Straw Diversion Device (SSDD) diverting the suction straw towards the perimeter of the bottle and in the liquid. (1) Indicates liquid level. (2) Indicates the Suction Straw Diversion Device (SSDD).

FIG. 4: shows a tilted round spray bottle with the SSDD diverting the suction straw towards the perimeter of the bottle where a very low level of liquid is pooling and the suction straw still in the liquid, thus being able to be sprayed. (1) Indicates liquid level. (2) Indicates the Suction Straw Diversion Device (SSDD).

FIG. 5: shows an oblong spray bottle standing upright with very little liquid in the bottle. The sprayer suction straw is going straight down and is in the liquid thus allowing the liquid to be sprayed. (1) Indicates liquid level.

FIG. 6: shows an oblong spray bottle tilted forward with the sprayer suction straw going straight down and the liquid pooling a the front of the bottle not allowing the sprayer to spray the liquid. (1) Indicates liquid level.

FIG. 7: shows an oblong spray bottle upright with very little liquid with the sprayer suction straw diverted by the Suction Straw Diversion Device (SSDD) diverting the suction straw towards the perimeter of the bottle and in the liquid. (1) Indicates liquid level. (2) Indicates the Suction Straw Diversion Device (SSDD).

FIG. 8: shows a tilted oblong spray bottle with the SSDD diverting the suction straw towards the perimeter of the bottle where a very low level of liquid is pooling and the suction straw still in the liquid, thus being able to be sprayed. (1) Indicates liquid level. (2) Indicates the Suction Straw Diversion Device (SSDD).

FIG. 9: shows an oblong spray bottle upright with the sprayer device turned around to face the back of the bottle with a low liquid level and the suction straw diverted to the front of the bottle by the SSDD and the straw still in the liquid. (1) Indicates liquid level. (2) Indicates the Suction Straw Diversion Device (SSDD).

FIG. 10: shows an oblong spray bottle leaning forward with the sprayer turned facing the back of the bottle. The bottle has a low level of liquid and the suction straw is diverted towards the front of the bottle with the suction straw in the liquid allowing it to be sprayed upwards. (1) Indicates liquid level. (2) Indicates the Suction Straw Diversion Device (SSDD).

FIG. 11: shows an oblique view of an oblong spray bottle with a SSDD diverting the suction straw towards the front of the bottle. (1) Indicates the Suction Straw Diversion Device (SSDD).

DETAILED DESCRIPTION OF THE INVENTION

This invention of a Suction Straw Diversion Device (SSDD) is built into bottles that are produced through plastic injection molding or other processes common to bottle making. Bottles with a SSDD can be similar to any spray bottles currently on the market today. For the purpose of this paper, two bottle shapes will be used, but the concept of the SSDD can be used in any of the bottle designs. This spray bottle has a SSDD that is double tapered hollow/tubular in design. (See FIG. 11, (1).) It is located near the bottom-lower part of the spray bottle and is located towards the front or near the edge of the spray bottle depending on the bottle design. A spray bottle with a SSDD pushes the sprayer bottles sprayer suction straw to any area of the perimeter at the bottom of the bottle next to the wall of the bottle. This allows the bottle to be more efficient and allows it to suck up and spray the contents of the bottle when the bottle is at a low to almost empty stage.

what is claimed is:

1. A spray device, comprising:

a bottle defining a cavity for holding a liquid, the bottle capped by a spray pump and having a first side and a second side, the first side opposing the second side;

a straw coupled to the spray pump and passing through the cavity; and a hollow tube extending from the first side to the second side, the tube defining a hole that extends from the first side to the second side, the hole exposed on the first side of the bottle and on the second side of the bottle, wherein the straw abuts the tube such that an end of the straw is retained in a first corner of the bottle, wherein the tube has a first mouth at the first end and a second mouth at the second end, wherein the hole extends from the first mouth to the second mouth, and wherein the first and second mouths are aligned such that a user can see through the hole from the first mouth to the second mouth, and wherein the straw is pressed against the tube such that the straw is bent.

2. The spray device of claim 1, wherein the tube is tapered between the first and second sides such that a cross-sectional area of the hole between the first and second mouths is less than a cross-sectional area of the first mouth.

3. The spray device of claim 2, wherein the cross-sectional area of the hole is less than a cross-sectional area of the second mouth.

4. The spray device of claim 1, wherein the straw does not pass through the hole.

5. The spray device of claim 1, wherein the tube is tapered.

6. The spray device of claim 1, wherein the bottle is capped by the spray pump at a top of the bottle, wherein the bottle has a bottom opposite of the top, and wherein the tube is closer to the bottom than the top.

7. The spray device of claim 6, wherein the first corner is at the bottom, wherein the bottle has a second corner that is opposite of the first corner, wherein the second corner is at the bottom, and wherein the tube is closer to the first corner than the second corner.

8. The spray device of claim 7, wherein the bottom is flat.

* * * * *